US009082274B2

(12) United States Patent
Goto et al.

(10) Patent No.: US 9,082,274 B2
(45) Date of Patent: Jul. 14, 2015

(54) ODOR GENERATION ALARM AND METHOD FOR INFORMING UNUSUAL SITUATION

(75) Inventors: Hideaki Goto, Kobe (JP); Tomo Sakai, Kobe (JP); Koichiro Mizoguchi, Kobe (JP); Yukinobu Tajima, Tokyo (JP); Makoto Imai, Kusatsu (JP)

(73) Assignees: AIR WATER SAFETY SERVICE, INC., Hyogo (JP); SEEMS INC., Tokyo (JP)

( * ) Notice: Subject to any disclaimer, the term of this patent is extended or adjusted under 35 U.S.C. 154(b) by 912 days.

(21) Appl. No.: 12/735,638

(22) PCT Filed: Feb. 5, 2009

(86) PCT No.: PCT/JP2009/051995
§ 371 (c)(1),
(2), (4) Date: Aug. 4, 2010

(87) PCT Pub. No.: WO2009/099157
PCT Pub. Date: Aug. 13, 2009

(65) Prior Publication Data

US 2010/0308995 A1 Dec. 9, 2010

(30) Foreign Application Priority Data

Feb. 5, 2008 (JP) ..... P2008-025759

(51) Int. Cl.
*G08B 21/00* (2006.01)
*G08B 15/02* (2006.01)
(Continued)

(52) U.S. Cl.
CPC *G08B 15/02* (2013.01); *G08B 1/00* (2013.01); *G08B 5/40* (2013.01)

(58) Field of Classification Search
CPC .... B05B 7/2443; B05B 7/12; B05B 11/3011; B05B 9/0888; B65D 83/64; B65D 83/663; B65D 25/40
USPC ..... 340/500, 540, 693.6
See application file for complete search history.

(56) References Cited

U.S. PATENT DOCUMENTS 3,583,491 A * 6/1971 Lindeberg ..... 169/73
5,055,822 A 10/1991 Campbell et al.
(Continued)

FOREIGN PATENT DOCUMENTS

GB 2 166 239 4/1986
JP 06-076179 3/1994
(Continued)

OTHER PUBLICATIONS

Machine Translation for JP 2002370559 A.*
(Continued)

*Primary Examiner* — James Yang
(74) *Attorney, Agent, or Firm* — Harness, Dickey & Pierce, P.L.C.

(57) ABSTRACT

An odor generation alarm and a method for informing an unusual situation having a high attention attracting effect and a high degree of safety are provided. An odor generation alarm includes an odorant receptacle, a drive section, a detector and a circuit section which is a controller. The odorant receptacle contains an odorant. A concentration of the odorant in air at which a person can no longer tolerate a strength of smell is lower than a no observed effect concentration of the odorant. The drive section causes the odorant to be emitted from the odorant receptacle. The detector detects occurrence of an unusual situation, and outputs a detection signal. When the detection signal from the detector is inputted, the controller causes the drive section to emit the odorant in accordance with the detection signal.

8 Claims, 6 Drawing Sheets

(51) Int. Cl.
*G08B 1/00* (2006.01)
*G08B 5/40* (2006.01)

(56) References Cited

U.S. PATENT DOCUMENTS

| | | | | |
|---|---|---|---|---|
| 6,881,382 | B2 * | 4/2005 | Goldstein et al. | 422/123 |
| 2006/0290522 | A1 * | 12/2006 | Tajima et al. | 340/577 |

FOREIGN PATENT DOCUMENTS

| | | | | |
|---|---|---|---|---|
| JP | 11-151079 | | | 6/1999 |
| JP | 11151079 | A | * | 6/1999 |
| JP | 2002-370559 | | | 12/2002 |
| JP | 2002370559 | A | * | 12/2002 |
| JP | 2004-246462 | | | 9/2004 |
| JP | 2004-326326 | | | 11/2004 |
| JP | 2006-059000 | | | 3/2006 |
| JP | 2006-146599 | | | 6/2006 |
| JP | 2007-122606 | | | 5/2007 |

OTHER PUBLICATIONS

Machine Translation for JP 11151079 A.*

International Preliminary Report on Patentability dated Aug. 19, 2010 and English translation thereof.

Extended search report for corresponding European patent application No. 09708454.5 dated Jan. 31, 2012.

Office Action dated Jan. 31, 2013 for corresponding Chinese patent application No. 200980104206.6 with English translation.

Office Action dated Mar. 19, 2012 for corresponding Chinese patent application No. 200980104206.6 with English translation.

International Search Report dated Mar. 17, 2009.

Japanese Office Action dated May 19, 2009.

Japanese Office Action dated Aug. 4, 2009.

Japanese Office Action dated Nov. 10, 2009.

Taiwanese Office Action and English concise explanation dated Apr. 22, 2014.

* cited by examiner

ODOR GENERATION ALARM AND METHOD FOR INFORMING UNUSUAL SITUATION

TECHNICAL FIELD

The present invention relates to an odor generation alarm and a method for informing an unusual situation which inform of an unusual situation, such as a fire, by generating an odor.

BACKGROUND ART

An alarm according to a first conventional art detects heat, smoke, a gas, light of a flame, and the like caused by a fire, and determines that there is a fire from them individually, or from a combination thereof in order to prevent a false alarm or the like. A signal which is outputted on detection of a fire is sent to a fire extinguishing device and, along with a bell or the like being rung, a sprinkler or the like operates.

As an alarm according to a second conventional art, there is disclosed a fire alarm which can inform even people with a hearing impediment of the occurrence of a fire when a fire occurs. This fire alarm informs of the occurrence of an unusual situation, namely a fire by diffusing an odorant when a fire occurs. In this fire alarm, mainly methyl mercaptan is used as a gas odorant (for example, refer to Japanese Unexamined Patent Publication JP-A 2004-326326).

DISCLOSURE OF INVENTION

An alarm sound caused by the alarm according to the first conventional art is difficult to hear for a person with a hearing impediment, and therefore there is a problem in that a delay occurs in the start of evacuation.

The lethal dose (lethal dose 50, abbreviated as "LD50") of methyl mercaptan used in the fire alarm device according to the second conventional art is 2.4 mg/kg, and there is a problem in that when coming into contact with the skin, it causes reddening and pain of the skin, causes frostbite when touching the liquid, and causes reddening and pain when entering the eyes.

An object of the invention is to provide an odor generation alarm and a method for informing an unusual situation having a high attention attracting effect and a high degree of safety.

According to the invention, an odor generation alarm comprises an odorant receptacle, a drive section, a detector, and a controller. The odorant receptacle contains an odorant. A concentration of the odorant in air at which a person can no longer tolerate a strength of smell is lower than a no observed effect concentration of the odorant. The drive section causes the odorant to be emitted from the odorant receptacle. The detector detects occurrence of an unusual situation, and outputs a detection signal. When the detection signal from the detector is inputted, the controller causes the drive section to work in accordance with the detection signal to cause the odorant to be emitted.

According to the invention, in the event that an unusual situation occurs, it is possible to inform of the occurrence of the unusual situation with a smell. As the concentration of the odorant at which a person becomes unable to tolerate the strength of smell is lower than the no observed effect concentration of the odorant, it is possible for a person to notice the smell of the odorant before the concentration in air of the odorant reaches the no observed effect concentration of the odorant. Consequently, it is possible to realize an odor generation alarm having high attention attracting effect and high degree of safety.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1:
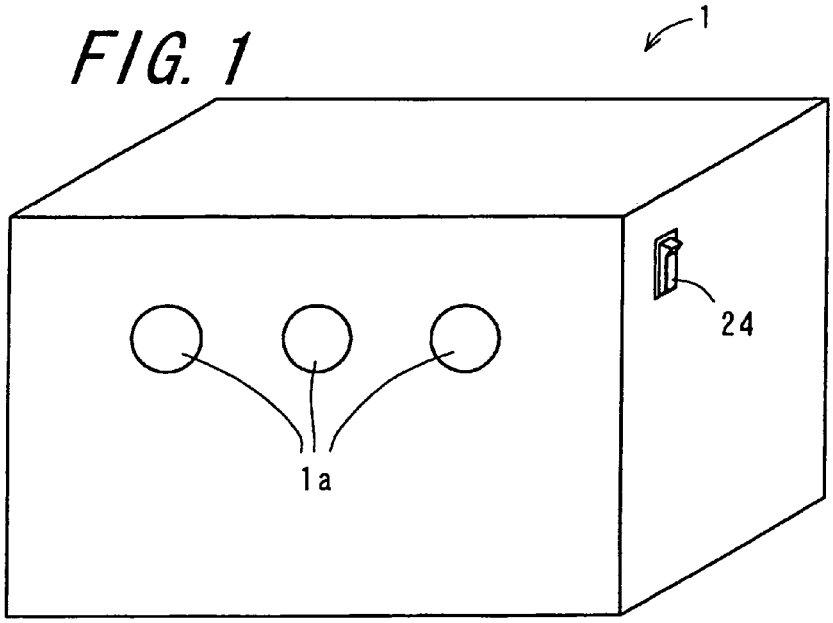
FIG. 1 is a perspective view of an odor generation alarm 1 according to one embodiment of the invention.

Hereafter, a description will be given, while referring to the drawings, of a plurality of embodiments of the invention. In the following description, portions in each embodiment corresponding to items already described in a previous embodiment will be denoted by identical reference numerals and characters, and a duplicated description will be omitted. In the event of describing only one portion of a configuration, it is taken that other portions of the configuration are the same as in a previously described embodiment. As well as a combination of portions specifically described in each embodiment, it is also possible to partially combine embodiments, as long as there is no particular impediment to the combination. The following description also includes a description of an odor generation alarm and a method for informing an unusual situation.

FIG. 1 is a perspective view of an odor generation alarm 1 according to one embodiment of the invention. The odor generation alarm 1 is a device which informs of an unusual situation such as a fire. The method for informing an unusual situation is a method of warning of an unusual situation such as a fire, using the odor generation alarm 1. The odor generation alarm 1 is configured to include a spray can 11, which is an odorant receptacle, a drive section 10, a detector 4, and a circuit section 7, which is a controller. Among them, the spray can 11, drive section 10, and circuit section 7 are included in an odor generating unit 1*a*, and are integrally formed.

The spray can 11 contains an odorant. The concentration of the odorant in air at which a person can no longer tolerate a strength of smell is lower than a no observed effect concentration of the odorant. The drive section 10 emits the odorant from the spray can 11. The detector 4 detects the occurrence of an unusual situation, and outputs a detection signal. When the detection signal from the detector 4 is inputted to the circuit section 7, the circuit section 7 causes the drive section 10 to emit the odorant in accordance with the detection signal. The drive section 10 causes the odorant to be emitted from the spray can 11 into a space outside the alarm, and makes the concentration of the odorant in the space outside the alarm be a predetermined concentration which is lower than the no observed effect concentration. By this means, a person in a sleeping condition in the space outside the alarm is awakened. Also, a person who is awake rather than in a sleeping condition is warned of the occurrence of an unusual situation, and alerted into awareness.

Figure 2:
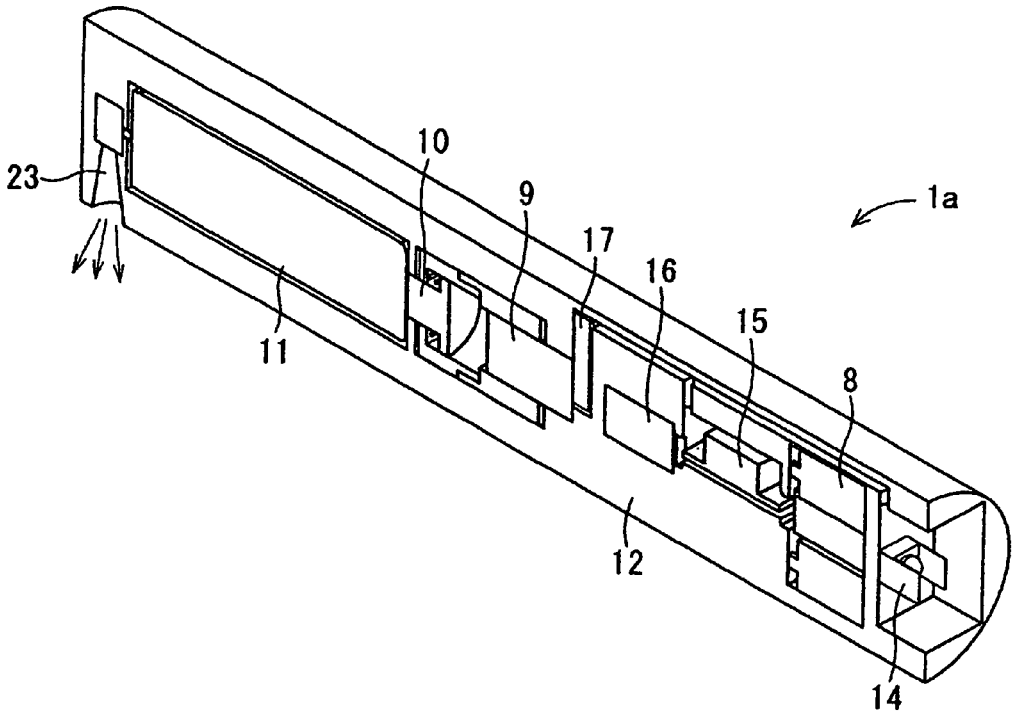
FIG. 2 is a simplified sectional perspective view showing an odor generating unit 1*a* according to one embodiment of the invention.
Figure 3:
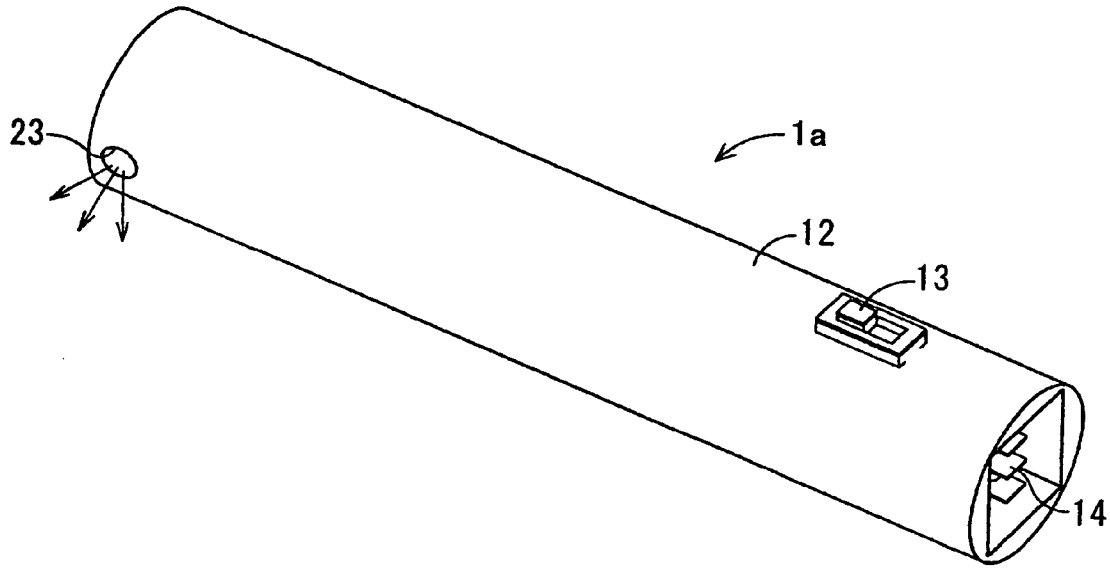
FIG. 3 is a simplified perspective view showing the odor generating unit 1*a;*
Figure 4:
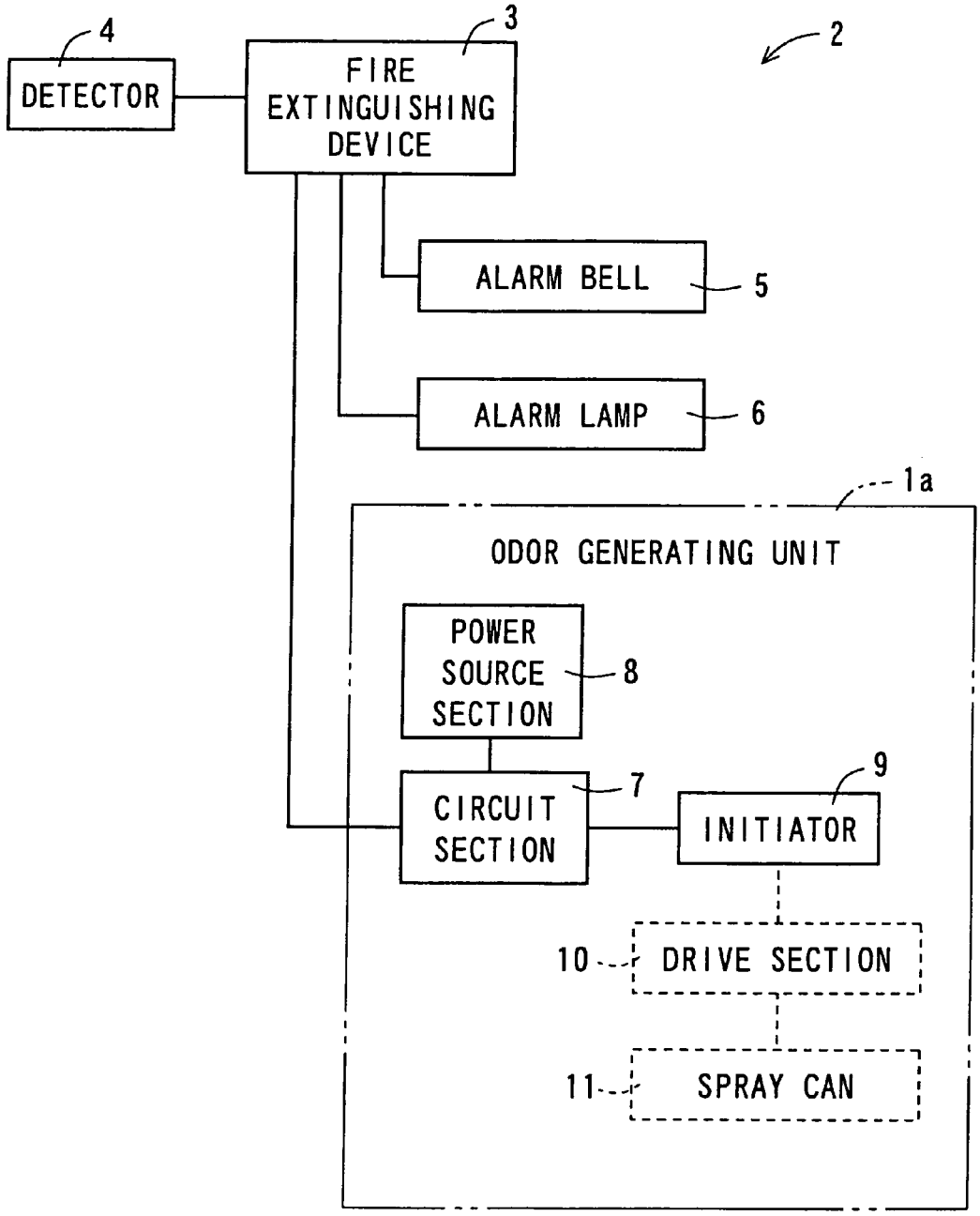
FIG. 4 is a block diagram showing an electrical configuration of an alarm system 2 including the odor generating unit 1*a;*

FIG. 2 is a simplified sectional perspective view showing the odor generating unit 1*a* according to one embodiment of the invention. FIG. 3 is a simplified perspective view showing the odor generating unit 1*a*. FIG. 4 is a block diagram showing an electrical configuration of an alarm system 2 including the odor generation alarm 1. The alarm system 2, on detecting an unusual situation such as a fire, activates a fire extinguishing device 3, such as a sprinkler. The fire extinguishing device 3, in the event of an unusual situation, informs that there is an unusual situation via the odor generating unit 1*a*, which functions as alarm means. The alarm system 2, referring to FIG. 4, is configured to include the detector 4, the fire extinguishing device 3, the odor generating unit 1*a*, and an alarm bell 5 and alarm lamp 6 which function as another alarm means.

The detector 4, which is detection means, detects the occurrence of an unusual situation and, on detecting that an unusual situation has occurred, sends the fire extinguishing device 3 a detection signal indicating that an unusual situation has occurred. The detector 4 is configured so as to detect, for example, heat, smoke, a gas such as carbon monoxide, the light of a flame, and the caused by a fire, and determine that there is a fire from them individually, or from a combination thereof in order to prevent a false alarm. The detector 4, in the event of determining that there is a fire based on the detected information, sends the fire extinguishing device 3 a detection signal.

The fire extinguishing device 3, which is electrically connected to the detector 4, starts a fire extinguishing operation when the detection signal is sent from the detector 4. The fire extinguishing device 3 activates, for example, fire extinguishing means such as a sprinkler, a smoke extracting device, and the like. Also, when the detection signal is sent from the detector 4, the fire extinguishing device 3 controls the alarm means 1, 5, and 6 so as to set off an alarm. The alarm bell 5, the alarm lamp 6, and the odor generating unit 1*a*, which are alarm means, are each electrically connected to the fire extinguishing device 3, and set off an alarm when the detection signal is sent from the fire extinguishing device 3. The alarm bell 5 sets off an audible alarm, the alarm lamp 6 emits light, and the odor generating unit 1*a* emits an odor.

Next, referring to FIG. 4, a detailed description will be given of an electrical configuration of the odor generating unit 1*a*. The odor generating unit 1*a* includes the circuit section 7, a power source section 8, an initiator 9, the drive section 10, and the spray can 11. In FIG. 4, in order to facilitate understanding, the drive section 10 and spray can 11, which are not electrically connected, are shown hypothetically. The circuit section 7, having a function as control means, activates the initiator 9 when the detection signal is sent from the detector. The circuit section 7, which is electrically connected to the detector 4, supplies a current to the initiator 9 when the detection signal is sent from the detector 4. The initiator 9 produces heat in accordance with the current, and an igniting agent (an explosive) included in the initiator 9 ignites. On the igniting agent igniting, a gas forming agent chemically reacts due to the heat of the explosive, and a gas is formed. The drive section 10 is activated by the pressure of the gas, displacing the spray can 11. Because of this, a liquid odorant loaded in the spray can 11 is emitted. Consequently, the initiator 9 and drive section 10, having a function as switching means, switch from an emission stopped condition to an emission condition by displacing the spray can 11 with respect to a casing 12.

Figure 5:
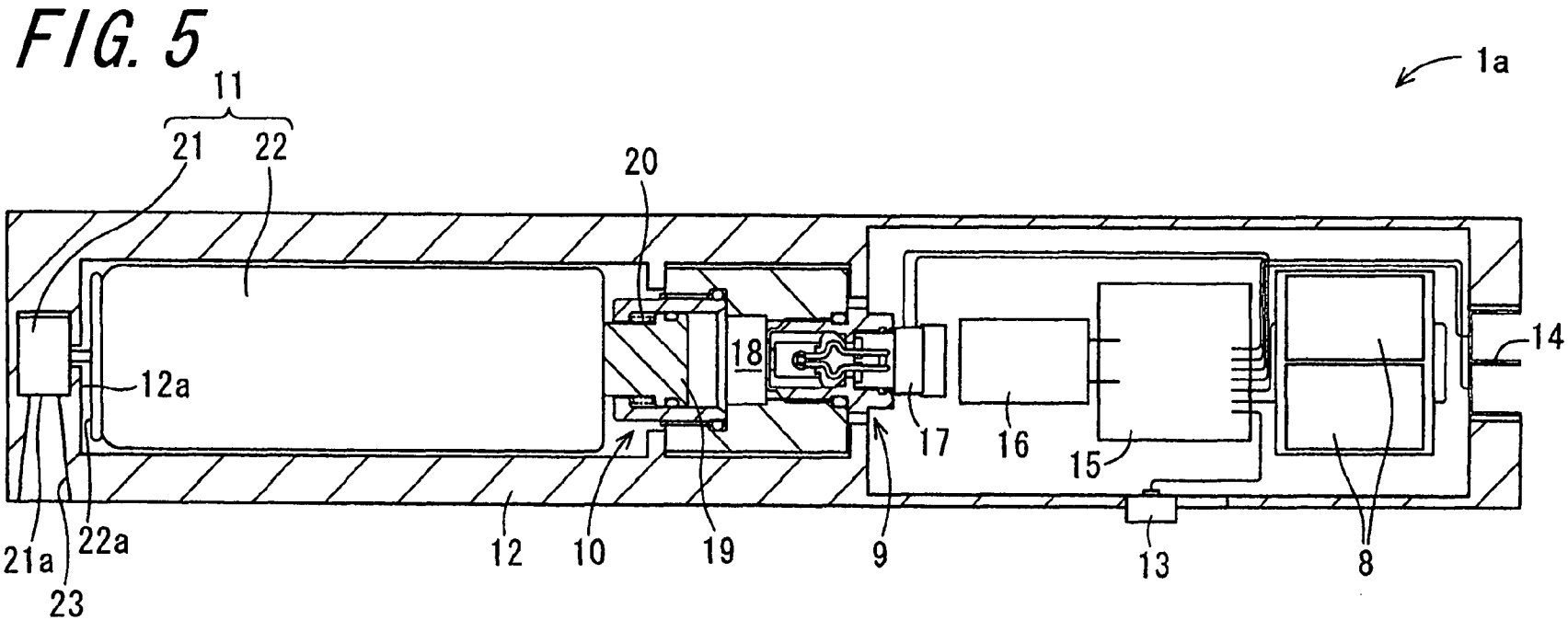
FIG. 5 is a sectional view showing the odor generating unit 1*a;*

FIG. 5 is a sectional view showing the odor generating unit 1*a*. Referring to FIGS. 2 and 3 at the same time, a description will be given of a mechanical configuration of the odor generating unit 1*a*. The odor generating unit 1*a* further includes a casing 12 and a power switch 13. The casing 12 is configured of a tubular member extending along a predetermined axis, in which are formed a housing space which can house the spray can 11, and a disposition space which can house each section. The disposition space is formed adjacent to the housing space, in which are housed the power source section 8, drive section 10, initiator 9, and circuit section 7. Also, the power switch 13 is provided in the periphery of the casing 12, and is configured so as to enable a switching of the condition of a supply of electricity from the power source section 8 to the circuit section 7.

The circuit section 7 includes a terminal block 14, a circuit substrate 15, a capacitor 16, and a connector 17. The terminal block 14 is a portion electrically connected to the detector 4 via a cable, or the like. The terminal block 14 is, for example, provided in one end portion in an axial direction of the casing 12 so as to be exposed to the exterior, as shown in FIG. 3. The terminal block 14 is electrically connected to the circuit substrate 15. Consequently, a detection signal from the detector 4 is sent to the circuit substrate 15 via the terminal block 14.

The power source switch 13 is electrically connected to the circuit section 7, and can switch a state of a voltage from the power source section 8. The power source section 8 is implemented by a battery 8 or the like, is detachably disposed on the odor generating unit 1*a*, and can supply electrical power to the circuit substrate 15 when attached to the odor generating unit 1*a*. The battery 8 is implemented, for example, by a primary battery such as a dry cell 8 or a secondary battery such as a rechargeable battery.

The circuit substrate 15 charges the capacitor 16 in advance with the electrical power supplied from the battery 8 so as to provide the energy necessary for igniting the explosive contained in the initiator 9. The circuit substrate 15 is electrically connected to the capacitor 16 and the connector 17. The circuit substrate 15 supplies the current discharged to the capacitor 16 to the connector 17 based on a detection signal supplied from the terminal block 14. The connector 17 is electrically connected to the initiator 9, and operates the initiator 9 by supplying the current from the capacitor 16.

As described above, the initiator 9 is operated by the current supplied by the circuit section 7 from the capacitor 16, and generates gas. The generated gas is released to a sealed space 18 defined by the casing 12, the initiator 9, and the drive section 10, and increases the pressure in the sealed space 18. The air-tightness of this sort of sealed space 18 is maintained by an O-ring.

As described above, the drive section 10 is operated by the gas generated by the initiator 9. The drive section 10 includes a piston 19 and buffer means 20. The piston 19 defines the sealed space 18, and can be displaced along the axial direction of the casing 12 between a non-releasing position and a releasing position. The buffer means 20 buffers a shock generated when the spray can 11 displaces with respect to the casing 12. In this embodiment, the buffer means 20 is implemented by a spring member 20. The spring member 20 supplies a spring force so that the piston 19 displaces to one side in the axial direction.

The spray can 11 is detachably disposed in the housing space defined on the other side in the axial direction of the casing 12. The spray can 11 is filled with an odorous liquid and a compressed gas such as compressed air, and can release the odorous liquid in the form of fine particles by releasing the odorous liquid compressed by the compressed gas from a thin opening of a nozzle head 21. The spray can 11 can be switched between a releasing state in which the odorous liquid is released and a non-releasing state. The spray can 11 is implemented, for example, by a compressed gas cylinder. The spray can 11 is substantially cylindrical, and disposed in the housing space so that the axis of the spray can 11 substantially matches that of the casing 12. A head portion of the spray can 11 is disposed on the other side in the axial direction of the casing 12. The spray can 11 includes the nozzle head 21 that releases the odorous liquid and a pressure container 22 that is filled with the odorous liquid and the compressed gas. The nozzle head 21 that releases the odorous liquid filling the spray can 11 is disposed at the head portion of the spray can 11. The spray can 11 releases the odorous liquid by relatively displacing the nozzle head 21 and the pressure container 22 closer to each other. The pressure container 22 is disposed so as to be displaceable closer to the nozzle head 21 in the housing space. In the case where the spray can 11 is housed in the housing space and the spray can 11 is in the non-releasing state, an end wall portion 12*a* on the other side in the axial direction of the casing 12 that defines the housing space is away from an end face 22*a* of the pressure container 22 on the side facing the nozzle head 21. Furthermore, the nozzle head 21 is fixed to the casing 12 in the housing space in a state where the spray can 11 is housed in the housing space.

The casing 12 has a release opening 23 in a radial direction, which is the direction in which the odorous liquid is released from release aperture 21*a* of the nozzle head 21. The release opening 23 is tapered so as to expand outward in the radial direction. When the release opening 23 is tapered in this manner, the odorous liquid in the form of fine particles released from the nozzle head 21 can be efficiently dispersed without becoming attached to the inner circumferential face facing the release opening 23. The casing 12 and the drive section 10 are made of a material that is not deformed in an undesirable manner by the pressure of the gas generated by the initiator 9, such as brass, stainless steel, synthetic resin, or the like.

Figure 6:
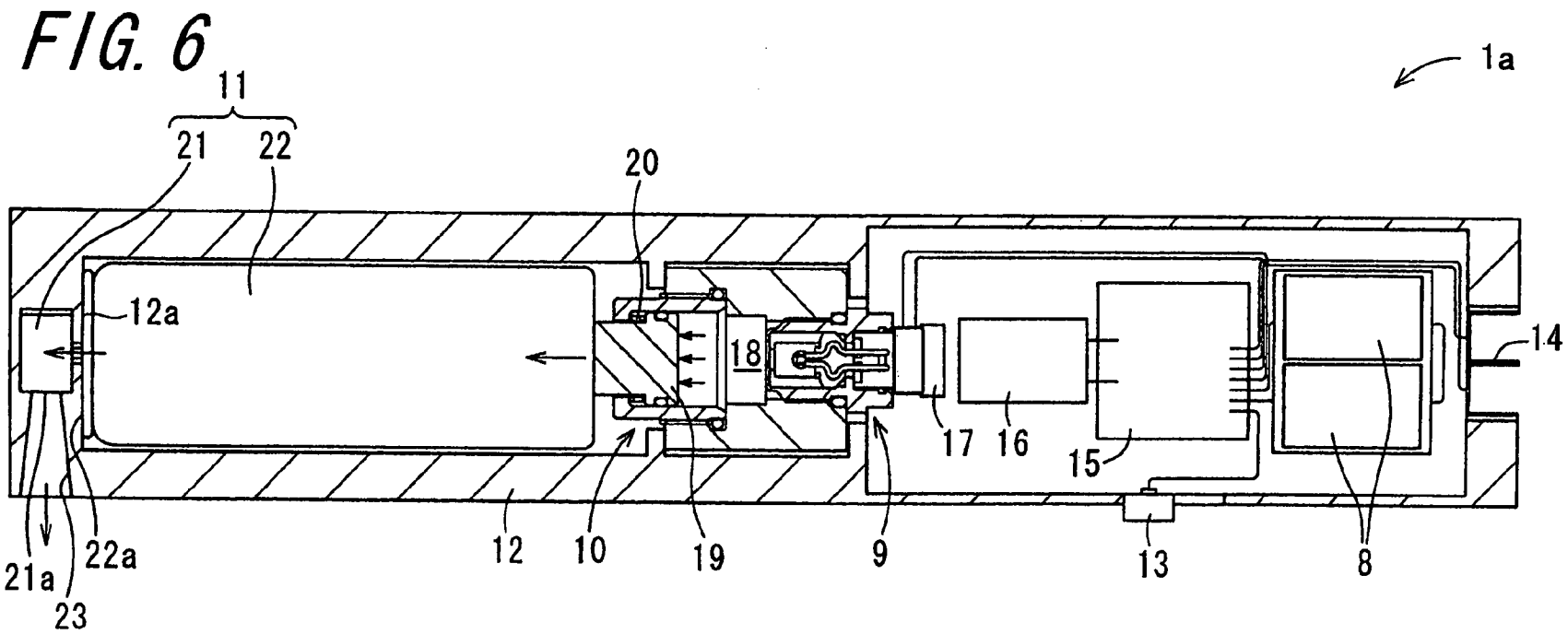
FIG. 6 is a cross-sectional view showing the odor-generating unit 1*a* in the case where a spray can 11 is in a releasing state.

FIG. 6 is a cross-sectional view showing the odor generating unit 1*a* in the case where the spray can 11 is in the releasing state. In a natural state where the pressure from the initiator 9 has no influence, the piston 19 is positioned at a non-releasing position closer to the one side in the axial direction due to the spring force of the spring member 20 (see FIG. 5). When the gas generated by the initiator 9 increases the pressure in the sealed space 18 as described above, the pressure of the gas acts on the piston 19 and displaces the piston 19 from the non-releasing position, to the other side in the axial direction, to the releasing position (see FIG. 6) acting against the spring force of the spring member 20.

Displacement of the nozzle head 21 is restricted by the casing 12, and the pressure container 22 is disposed so as to be displaceable with respect to the casing 12 from a non-releasing can position that corresponds to the non-releasing state (see FIG. 5) to a releasing can position that corresponds to the releasing state (see FIG. 6). As shown in FIG. 5, in the state where the pressure container 22 is at the non-releasing can position and the piston 19 is at the non-releasing position, the bottom portion of the spray can 11 is in contact with the face portion of the piston 19 on the other side in the axial direction. As shown in FIG. 6, in the state where the piston 19 has been displaced to the releasing position, the piston 19 presses the bottom portion of the pressure container 22 to the other side in the axial direction, and displaces the pressure container 22 from the non-releasing can position, to the other side in the axial direction, to the releasing can position. Accordingly, the end wall portion 12*a* on the other side in the axial direction of the casing 12 is in contact with the end face 22*a* of the pressure container 22 on the side facing the nozzle head 21. Since the nozzle head 21 is fixed to the casing 12, when the pressure container 22 displaces with respect to the nozzle head 21 in a direction closer to the releasing can position, the odorous liquid is released from the nozzle head 21. Since the gas generated by the initiator 9 is present in the sealed space 18, the pressure of the gas displaces the piston 19 to the releasing position (see FIG. 6) and maintains this state. Accordingly, the state in which the pressure container 22 is at the releasing can position is maintained, and thus, the odorous liquid is continuously released from the nozzle head 21.

A gas which does not combust even in a flame, or air, is adopted as the gas loaded in the spray can 11. An odorant agent of the liquid odorant loaded in the spray can 11 is adopted with the prerequisite that it conveys the fact that there is an unusual situation, and encourages evacuation activity. Specifically, the odorant includes allyl isothiocyanate (abbreviated as "AIT", chemical formula "$CH_2{=}CHCH_2N{=}C{=}S$"). AIT, which is a substance also referred to as "3-isothiocyanate-1-propene" by the International Union of Pure and Applied Chemistry, is also called allyl mustard oil, and is the substance which is the source of the pungent odor of wasabi.

AIT, which is recognized as a food additive used for flavoring purposes by Food Chemistry Division, Environmental Health Bureau, Health and Welfare Ministry under the Food Sanitation Act, is widely used in processed meats (70 ppm), pickles (80 ppm), condiments such as sauces (50 ppm), and the like. It does not dissolve easily in water, and is volatile. Also, AIT is also recognized as a usable raw material under the Ministry of International Trade and Industry administered Chemical Evaluation Regulations, which regulate raw materials used in chemical products such as sundries.

AIT is such that a person starts to notice a pungent odor at around the point at which the concentration exceeds an amount of substance of 1 ppm (parts per million, abbreviation "ppm"), and recognizes that it is the smell of wasabi from around 5 ppm. Hereafter, when using the unit "ppm", a ratio when comparing with an amount of substance having moles ("mol") as a unit is expressed. It is known that when AIT's concentration reaches 10 ppm or more, a person becomes unable to tolerate the atmosphere. The no observed effect concentration of AIT with respect to a person is 74.3 ppm, and the concentration at which a person becomes unable to tolerate the atmosphere is low in comparison with the no observed effect concentration.

This is a factor in being able to avoid inhalation toxicity. The lethal inhaled concentration (inhaled LC50) when exposed for four hours is 155 ppm in mice, and 173 ppm in rats. The orally administered lethal dose (LD50) is 310 mg/kg in mice. As the orally administered LD50 of methyl mercaptan is 2.4 mg/kg, AIT is a safe substance in comparison with methyl mercaptan.

In ocular instillation tests using domestic rabbits, when AIT diluted to 0.1% to 10% with corn oil is introduced into the eyes, nothing more than transient edema and conjunctival hyperemia is observed. As there is a lachrymatory effect on humans, the danger of a toxic effect on the eyes developing is still lower than in the ocular instillation tests using domestic rabbits. The acute dermal toxicity is LD50 88 mg/kg in rabbits. AIT is also contained at around 40 to 120 ppm in crucifers such as cabbages, cauliflowers, and Brussels sprouts.

The drive section in the embodiment causes the odorant to be emitted from the odorant receptacle, and makes the concentration in air of AIT in the space outside the alarm be 5 ppm or more and 20 ppm or less by amount of substance.

Consequently, AIT has no adverse effect on the human body in this concentration range. Furthermore, it is preferable that the range of concentration in air of AIT outside the odor generation alarm 1 is 5 ppm or more and 15 ppm or less. It has been confirmed by experiment that a person is awakened by the odor of AIT at these concentrations. In the embodiment, when the AIT contained in the spray can 11 is diffused evenly in an object section used, an amount of substance such that the previously described concentration range is attained is sprayed out in one burst. Because of this, when an unusual situation occurs, it is possible to inform a person of the occurrence of the unusual situation in as short a time as possible.

A substance other than AIT may be used as the odorant, provided that it is a substance whose concentration in air at which a person becomes unable to tolerate the strength of smell is lower than the no observed effect concentration, and it is also possible to use an odorant other than AIT mixed together with AIT. For example, menthol ((1RS,2SR,5RS)-2-isopropyl-5-methylcyclohexanol and its enantiomer) may be included.

As shown in FIG. 1, the odor generation alarm 1 further includes an operating section 24. The operating section 24, which is able to switch between a plurality of conditions in response to an operation from the exterior, outputs signals indicating each condition to the circuit section 7, which is the controller. When the operating section 24 is switched to a predetermined condition from a condition differing from that condition after the drive section 10 causes the odorant to be emitted from the odorant receptacle, the circuit section 7 causes the drive section 10 to stop a further emission of the odorant from the odorant receptacle. A configuration may be adopted wherein the operation itself of the drive section 10 is stopped in the predetermined condition, and a configuration may also be adopted wherein, in the event that the operating section 24 is in the predetermined condition when the odor generation alarm 1 begins to operate, the drive section 10 is drivable, and the operation of the drive section 10 is stopped when the operating section 24 is switched again to the predetermined condition after once being switched from the predetermined condition to another condition.

The operating section 24 in the embodiment is realized by, for example, a rocker switch, a slide switch, or the like. In the embodiment, the operating section 24 has two conditions, an on condition and an off condition, putting the wiring carrying out the supply of power to the drive section 10 in a conducting state in the on condition, and putting the wiring carrying out the supply of power to the drive section 10 in a non-conducting state, in a partway position, in the off condition.

Because of this, after a person becomes aware that there is an unusual situation, it is possible for the person to stop a further emission of the odorant by the drive section 10. After a person becomes aware that there is an unusual situation due to the emission of the odorant by the drive section 10, there is no need to further increase the concentration of the odorant in the space outside the alarm. By the person stopping the emission of the odorant, it is possible to prevent an unnecessary rise in the concentration of the odorant. Also, when an unusual situation occurs, it is possible to prevent the smell of the odorant disturbing the behavior of a person dealing with the unusual situation in the space outside the alarm.

The odor generation alarm 1 includes the spray can 11, which is the odorant receptacle, the drive section 10, the detector 4, and the circuit section 7, which is the controller. The odorant receptacle contains the odorant. The concentration of the odorant in air at which a person can no longer tolerate the strength of smell is lower than the no observed effect concentration of the odorant. The drive section 10 causes the odorant to be emitted from the odorant receptacle. The detector 4 detects the occurrence of an unusual situation, and outputs a detection signal. When the detection signal from the detector 4 is inputted, the circuit section causes the drive section 10 to work in accordance with the detection signal to cause the odorant to be emitted.

Because of this, in the event that an unusual situation occurs, it is possible to inform of the occurrence of the unusual situation with a smell. As the concentration of the odorant at which a person becomes unable to tolerate the strength of smell is lower than the no observed effect concentration of the odorant, it is possible for the person to notice the smell of the odorant before the concentration in air of the odorant reaches the no observed effect concentration of the odorant. Consequently, it is possible to realize an odor generation alarm with a high attention attracting effect, and with a high degree of safety.

The drive section 10 causes the odorant to be emitted from the odorant receptacle into a space outside the alarm, and makes the concentration of the odorant in the space outside the alarm be a predetermined concentration lower than the no observed effect concentration. By this means, a person in a sleeping condition in the space outside the alarm is awakened. Consequently, it is possible to safely awaken a person in a sleeping condition.

The odorant includes allyl isothiocyanate. The concentration in air of allyl isothiocyanate at which a person becomes unable to tolerate the strength of smell is one seventh or less of the no observed effect concentration of the substance. Consequently, even in the event that an error occurs in adjusting the concentration of the odorant in the space outside the alarm, it is possible to adjust to a concentration in the space outside the alarm which exceeds the concentration at which a person becomes unable to tolerate the strength of smell, and which is less than the no observed effect concentration.

The drive section causes the odorant to be emitted from the odorant receptacle, and makes the concentration in air of allyl isothiocyanate in the space outside the alarm be 5 ppm or more and 20 ppm or less by amount of substance. The concentration in air of allyl isothiocyanate at which a person becomes unable to tolerate the strength of smell is 10 ppm by amount of substance. Consequently, it is possible to reliably warn a person of the occurrence of an unusual situation. Also, the no observed effect concentration of allyl isothiocyanate is 74.3 ppm by amount of substance. Consequently, it is possible to inform a person of the occurrence of an unusual situation, with no adverse effect on the person.

Figure 7:
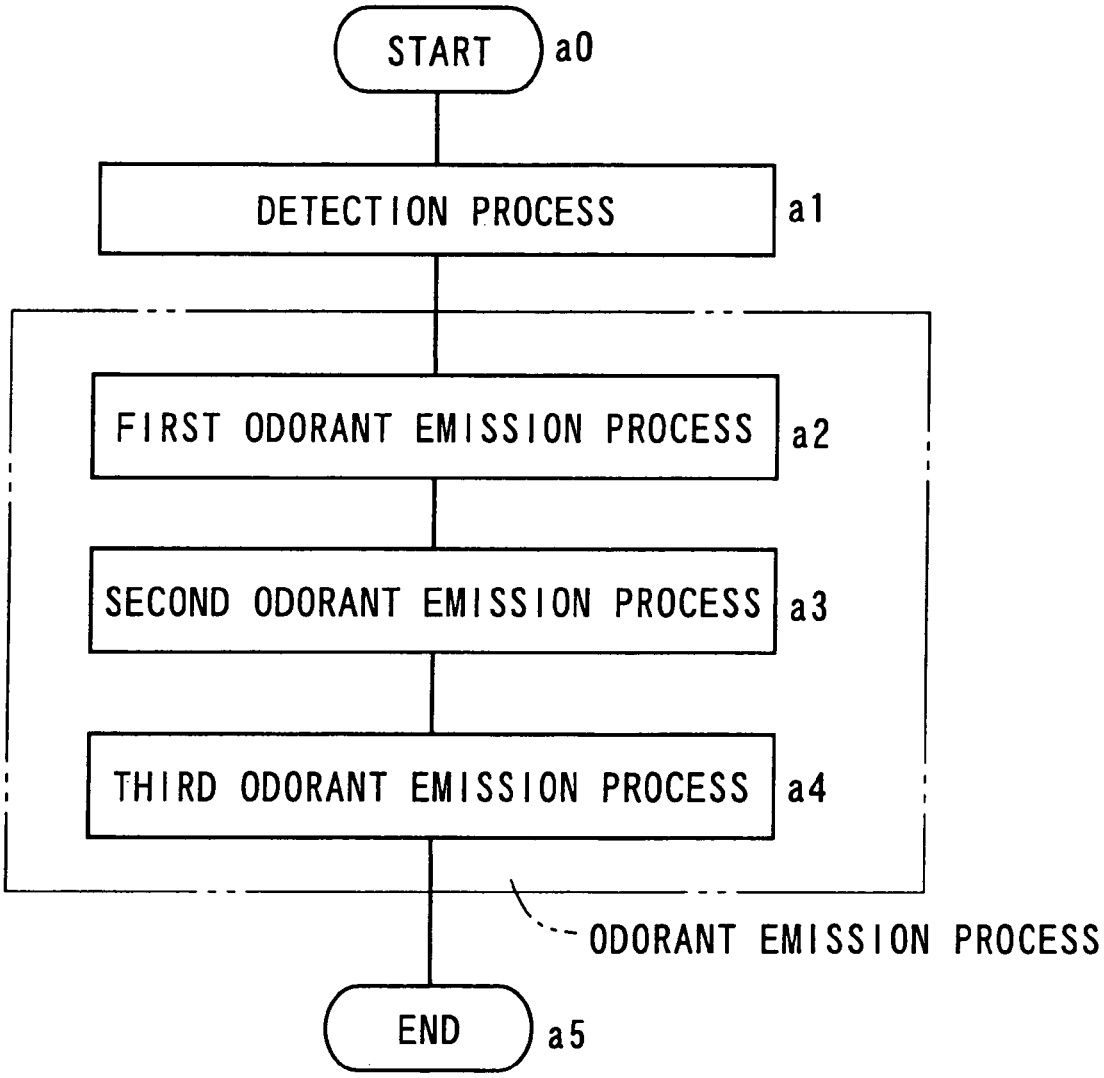
FIG. 7 is a flowchart showing processes of a method for informing an unusual situation according to one embodiment of the invention.

FIG. 7 is a flowchart showing processes of the method for informing an unusual situation according to one embodiment of the invention. The method for informing an unusual situation according to the embodiment, using the odorant receptacle, the drive section 10, the detector 4, and the controller, includes a detection process and an odorant emission process. In the detecting process, the occurrence of an unusual situation is detected by the detector 4. In the odorant emission process, the circuit section 7, which is the controller, causes the drive section 10 to emit the odorant from the spray can 11, which is the odorant receptacle. By this means, when an unusual situation occurs, it is possible to inform of the occurrence of the unusual situation with a smell. As the concentration of the odorant at which a person becomes unable to tolerate the strength of smell is lower than the no observed effect concentration of the odorant, it is possible for the person to notice the smell of the odorant before the concentration in air of the odorant reaches the no observed effect concentration of the odorant.

Another Embodiment

The odor generation alarm 1 according to this embodiment includes a plurality of odorant receptacles. A plurality of odor generating units 1*a* are installed in the odor generation alarm 1, and one each of the spray cans 11, which are the odorant receptacles, is installed in each odor generating unit 1*a*. In the embodiment, three odor generating units 1*a* are installed in the odor generation alarm 1. An odorant receptacle from which the drive section 10 causes the odorant to be emitted at one time is one portion of the plurality of odorant receptacles. In the embodiment, the drive section 10, carrying out an emission from one spray can 11 at one time, carries out the emission three times. The drive section 10 can stop a further emission of the odorant from the spray cans 11. The drive section 10 is formed in such a way that it is possible to stop the second and subsequent emissions of the odorant after the first emission, and to stop the third emission of the odorant after the second emission.

In the odorant emission process, the drive section 10 emits the odorant a plurality of temporally differing times. Specifically, the odorant emission process is configured of a first odorant emission process, a second odorant emission process, and a third odorant emission process, and the three odorant emission processes are carried out over three times, with time intervals therebetween. A plurality of spray cans 11 are included. In the odorant emission process, a spray can 11 from which the drive section 10 causes the odorant to be emitted at one time is one portion of the plurality of spray cans 11, and specifically, an emission of the odorant from one spray can 11 is carried out in one odorant emission process.

In the event that, hypothetically, the drive section 10 causes the odorant to be emitted from one spray can 11 over a plurality of times, it is necessary for the drive section 10 to stop the emission of the odorant from the spray can 11 in the course of causing the odorant to be emitted, but there are a plurality of spray cans 11, and it is possible, by causing an emission from one portion of the spray cans 11 at one time, to cause a rise in the concentration of the odorant divided over a plurality of times, without stopping the emission of the odorant from the spray can 11 caused to emit. Because of this, it is possible to reduce an error in the amount of odorant emitted at one time in comparison with the case of stopping the emission of the odorant from the spray can 11 in the course of causing the odorant to be emitted. Consequently, it is possible to cause the concentration of the odorant in the space outside the alarm to rise in stages with a high degree of accuracy.

In the odorant emission process, as the drive section 10 causes the odorant to be emitted a plurality of temporally differing times, it is possible to cause a rise in the concentration of the odorant, in the space outside the alarm into which the odorant is emitted, over a plurality of times. Consequently, it is possible to provide a time lag between the time until the concentration of the odorant reaches a concentration perceptible to a human, and the time until the concentration of the odorant reaches the previously described predetermined concentration. Because of this, it is possible to cause a person to perceive the occurrence of an unusual situation in lower concentration of the odorant than the concentration of the odorant in the space outside the alarm when all of the odorant contained in the odorant receptacle has been emitted. Consequently, compared with the configuration wherein the drive section 10 causes the odorant to be emitted at one time and makes the concentration of the odorant in the space outside the alarm be the predetermined concentration, it is possible to reduce the strength of smell felt by a person for the time period from when the person perceived the occurrence of an unusual situation until the person leaves the scene. Consequently, when an unusual situation occurs, it is possible to prevent the smell of the odorant disturbing the behavior of a person dealing with the unusual situation in the space outside the alarm.

Example

An experiment to confirm the advantage of the previously described kind of configuration was carried out with an object section of a room of 1.7 meters (meters, abbreviated as "m")× 2.15 m×2.5 m, with a capacity of 9.51 $m^3$, using one dummy can loaded with only compressed gas and three spray cans in the room. Four concentration sensors were installed on the wall in the vicinity of the head of the subject's bed, and measurement was carried out with these concentration sensors. Emissions of AIT from the spray cans 11 were carried out three times at intervals of 50 seconds to 100 seconds. At this time, the rise in the concentration of AIT in air was around 2 ppm, and experiment was carried out in various conditions including a concentration condition exceeding 24 ppm.

The same kind of experiment was also carried out in a room of 1.8 m×2.2 m×2.0 m, with a capacity of 7.92 $m^3$, confirming the advantage of the previously described configuration. In an experiment in which the emission from the spray cans was carried out one at a time, in the same way as with the unusual situation warning method according to the heretofore described other embodiment, the AIT concentration in the room containing the subject was made to be 5 ppm by the emission of AIT from the first spray can. This concentration was the concentration when AIT was diffused evenly over the whole of the room. Next, the AIT concentration of the room was made to be 10 ppm by the emission of AIT from the second spray can, and to be 15 ppm by the emission from the third spray can. In the experiment, the emission of AIT was carried out to achieve still higher concentration, and the previously described concentration range was decided as an AIT concentration range wherein a person is awakened from a sleeping condition and can carry out evacuation activity without impediment.

In these experiments, it was confirmed that when the concentration of AIT in air in the object section becomes 5 ppm or more and 20 ppm or less, as a ratio of the amount of substance, it is possible to safely awaken a person sleeping in the object section. Furthermore, it was found that when the concentration of AIT in the object section is 5 ppm or more and 15 ppm or less, it is possible to safely awaken a person sleeping in the object section and it is also possible to reduce the discomfort of the person in the object section in comparison with the case in which the AIT concentration exceeds 15 ppm.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

The invention claimed is:

1. An odor generation alarm, comprising:

an odorant receptacle which includes a nozzle head and a pressure container containing an odorant;

a tubular casing which houses the odorant receptacle therein;

a drive section which emits the odorant from the odorant receptacle;

a detector which detects occurrence of an emergency, and outputs a detection signal to a controller, wherein the odorant includes allyl isothiocyanate, the controller causes the drive section to emit the odorant into an object section in which the odor generation alarm is used in accordance with the detection signal, when the detection signal is inputted from the detector, and the drive section causes the odorant to be emitted from the odorant receptacle, and makes concentration in air of allyl isothiocyanate in the object section by 5 ppm or more and 20 ppm or less by amount of substance when the odorant is diffused evenly in the object section, wherein the nozzle head is fixed to the casing, and the pressure container is movable in an axial direction of the casing toward the nozzle head, the drive section includes a piston movable in the axial direction of the casing, and the piston, upon being activated, displaces the pressure container toward the nozzle head to emit the odorant from the odorant receptacle.

2. The odor generation alarm of claim 1, wherein the drive section causes the odorant to be emitted from the odorant receptacle into the object section, thereby a person in a sleeping condition in the object section is awakened.

3. The odor generation alarm of claim 1, wherein the concentration of allyl isothiocyanate is 5 ppm or more and 15 ppm or less by amount of substance.

4. A method for informing an emergency, the method comprising providing an odor generation alarm comprising an odorant receptacle which includes a nozzle head and a pressure container containing an odorant, a tubular casing which houses the odorant receptacle therein, a drive section which emits the odorant from the odorant receptacle, a detector which detects occurrence of an emergency and outputs a detection signal to a controller, and the controller which, when the detection signal is inputted from the detector, causes the drive section to work in accordance with the detection signal to cause the odorant to be emitted into an object section in which the odor generation alarm is used, the method comprising:

a detection process of detecting the occurrence of an emergency with the detector; and an odorant emission process of, when the occurrence of the emergency is detected in the detection process, causing the drive section to work by the controller to cause the odorant to be emitted from the odorant receptacle, wherein the odorant includes allyl isothiocyanate, the drive section, in the odorant emission process, makes concentration in air of allyl isothiocyanate in the object section be 5 ppm or more and 20 ppm or less by amount of substance when the odorant is diffused evenly in the object section, the nozzle head is fixed to the casing, and moving the pressure container in an axial direction of the casing toward the nozzle head, and the drive section includes a piston, and moving the piston in the axial direction of the casing, wherein the piston, upon being activated, displaces the pressure container toward the nozzle head to emit the odorant from the odorant receptacle.

5. The odor generation alarm of claim 1, wherein the odorant receptacle is held in a space in a casing of the odor generation alarm, and the drive section displaces the odorant receptacle within the space in the casing to emit the odorant from the odorant receptacle.

6. The odor generation alarm of claim 5, wherein the drive section includes an initiator comprising an igniting agent that produces heat in accordance with a current from the controller.

7. The odor generation alarm of claim 1, further comprising an electric switch in the casing and configured to stop emission of the odorant during emission from the odorant receptacle.

8. The odor generation alarm of claim 1, wherein the piston is in contact with a bottom surface of the pressure container upon being displaced.

* * * * *